US008354765B2

(12) United States Patent
Laliche et al.

(10) Patent No.: US 8,354,765 B2
(45) Date of Patent: Jan. 15, 2013

(54) ELECTRIC MOTOR

(75) Inventors: Christophe Laliche, Chozeau (FR); Serge Deltreil, Corbas (FR); Francisco Jimenez, Villeurbanne (FR)

(73) Assignee: Moteurs Leroy-Somer, Angouleme (FR)

( * ) Notice: Subject to any disclaimer, the term of this patent is extended or adjusted under 35 U.S.C. 154(b) by 467 days.

(21) Appl. No.: 12/676,976

(22) PCT Filed: Sep. 12, 2008

(86) PCT No.: PCT/FR2008/051646

§ 371 (c)(1),
(2), (4) Date: Apr. 12, 2010

(87) PCT Pub. No.: WO2009/047432

PCT Pub. Date: Apr. 16, 2009

(65) Prior Publication Data

US 2010/0200338 A1 Aug. 12, 2010

(30) Foreign Application Priority Data

Sep. 12, 2007 (FR) ..... 07 57521

(51) Int. Cl.
*B66B 5/00* (2006.01)

(52) U.S. Cl. ..... 310/83; 310/75 R

(58) Field of Classification Search ..... 310/67 R, 310/75 B, 75 R, 76, 77, 83; 187/263; 188/161; 74/63; *B66B 5/16, 11/04; F16D 65/14*
See application file for complete search history.

(56) References Cited

U.S. PATENT DOCUMENTS

| | | | | |
|---|---|---|---|---|
| 5,819,876 | A * | 10/1998 | Chao | 187/263 |
| 6,464,043 | B2 * | 10/2002 | Wang | 187/314 |
| 6,561,318 | B1 * | 5/2003 | Lamb | 187/263 |
| 6,889,959 | B2 * | 5/2005 | Cholinski | 254/342 |
| 8,191,689 | B2 * | 6/2012 | Tiner et al. | 187/285 |

FOREIGN PATENT DOCUMENTS

| | | |
|---|---|---|
| CH | 307742 | 8/1955 |
| FR | 1 603 143 | 4/1971 |
| GB | 629561 | 9/1949 |
| GB | 2 020 926 A | 11/1979 |

OTHER PUBLICATIONS

International Preliminary Report on Patentability issued in International Application No. PCT/FR2008/051646 on May 4, 2010, (with translation).
International Search Report issued in International Application No. PCT/FR2008/051646 on Apr. 15, 2009.

* cited by examiner

*Primary Examiner* — Tran Nguyen
*Assistant Examiner* — Naishadh Desai
(74) *Attorney, Agent, or Firm* — Oliff & Berridge, PLC

(57) ABSTRACT

A motor provided with a secondary driving system including: a casing; a dented wheel permanently rotating during the normal operation of the motor together with the rotor inside the casing; an endless screw that can be brought into a clutch engagement position in which the screw meshes with the dented wheel and in which the rotation of the screw drives the dented wheel in a non-reversible manner and that can be removed from said position in order to allow the normal operation of the motor; a driving member for manually rotating the endless screw, the driving member rotating about the same rotation axis as the endless screw and rotating the latter by direct engagement.

32 Claims, 16 Drawing Sheets

Figure 1:
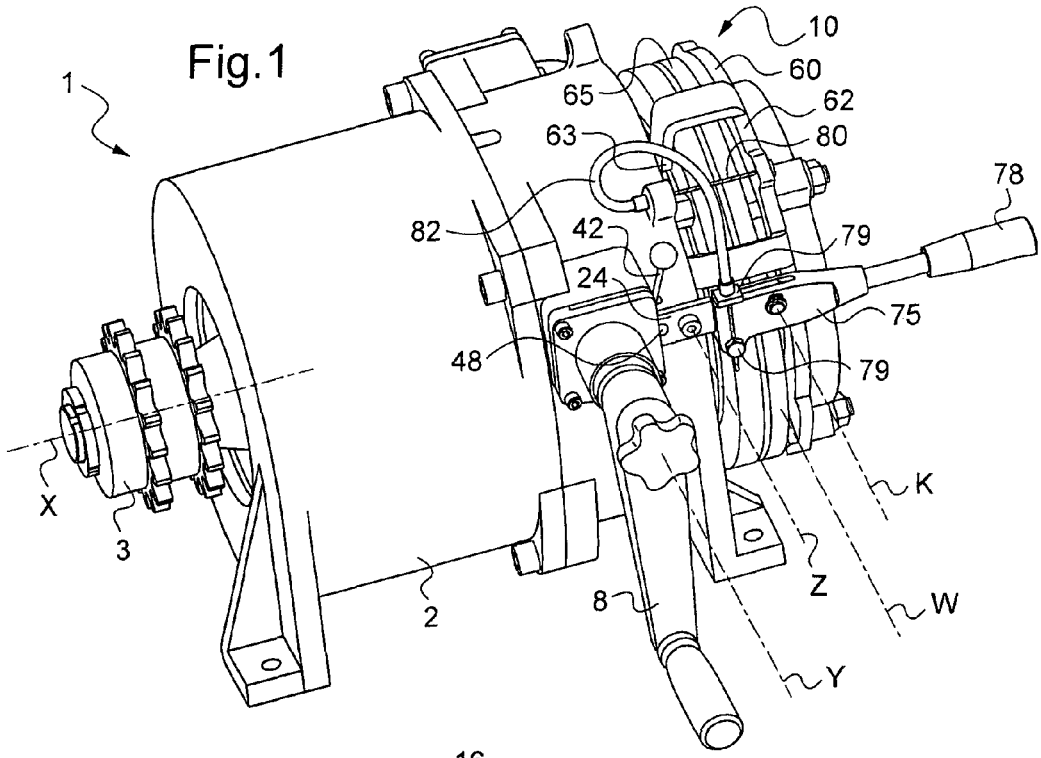

Fig.29
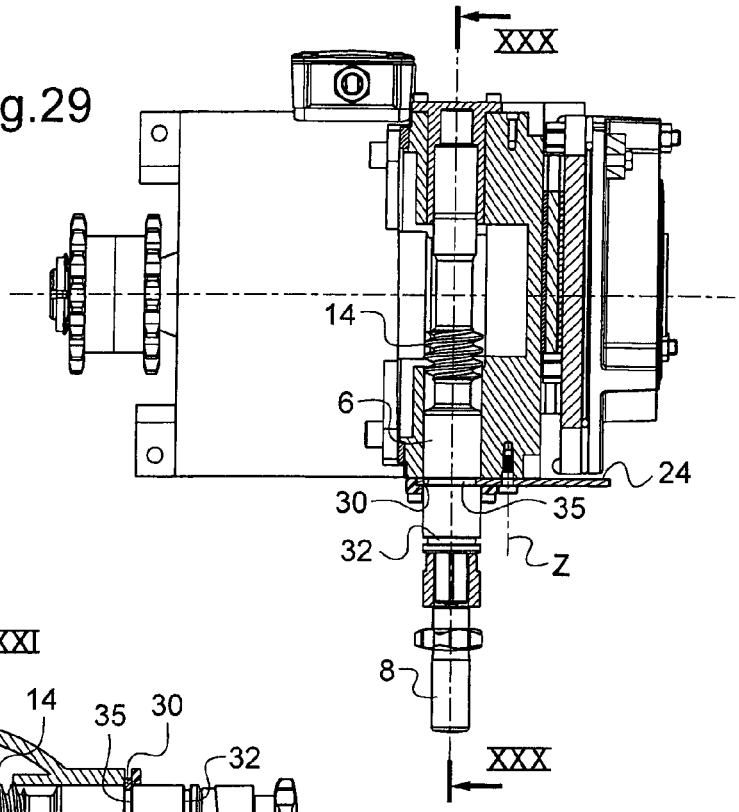
Fig.30
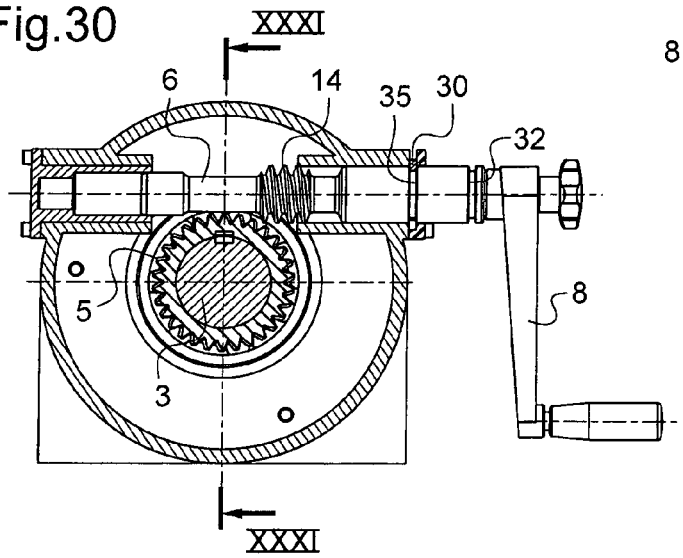
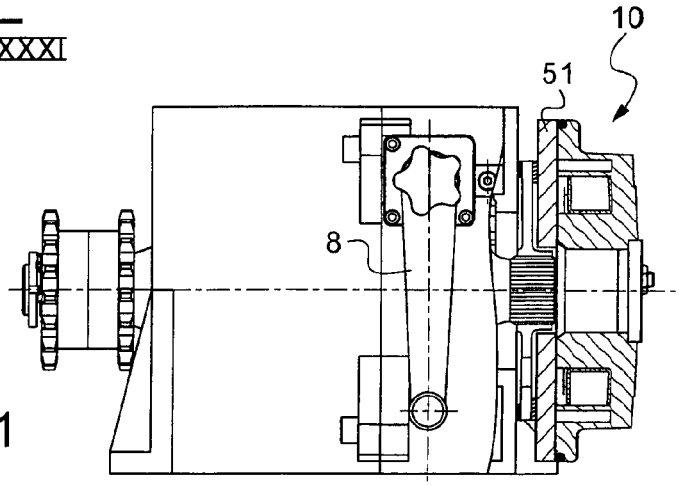
Fig.31

ELECTRIC MOTOR

The present invention concerns electric motors, and more particularly motors equipped with an auxiliary driving system making it possible to drive the rotor in rotation in the absence of electrical power from the motor.

Such auxiliary driving systems are useful in particular for the drive motors of elevator cars, by making it possible to move the car in case of loss of electrical power, when the car is stopped between two floors.

The invention more particularly, but not exclusively concerns motors equipped with a electromagnetic brake.

For such motors, the auxiliary driving system must enable the driving of the rotor while maintaining the safety of the passengers in the car and of the operator responsible for emergency maneuvering of the car.

U.S. Pat. No. 6,889,959 discloses an auxiliary driving system comprising a handwheel and a worm, adapted to be coupled to the motor if needed. Such a system is not provided to be left permanently coupled to the motor.

FR 1 603 143 and GB 2020 926 disclose auxiliary driving systems powered by an emergency electric motor.

The drawback of such an emergency electric motor is that it requires the presence of auxiliary electrical power, which may itself be subject to the failure and require additional maintenance.

CH 307742 and GB 629 561 disclose auxiliary driving systems comprising a handwheel, a toothed wheel and a worm which may or may not be coupled to the toothed wheel.

In GB 629 561, the worm may be driven manually and the coupling between the worm and the toothed wheel may be irreversible. The toothed wheel turns with the rotor driving the drive pulley of the cables. The system disclosed in this British patent is relatively bulky, being external to the drive motor of the pulley, and requires the construction and installation of bearings specific to the worm. In certain elevator configurations, the installation of such bearings may be impossible, or at least delicate due to the available space.

Patent CH 307742 describes a worm which is permanently housed inside a case containing a mechanism making it possible to downshift the rotation of the drive handwheel to cause the worm to turn, this mechanism being complex and relatively bulky.

There is a need to further improve the auxiliary driving systems and improve the ease of use and operating safety thereof.

The object of the invention is a new motor equipped with an auxiliary driving system which is simultaneously reliable, robust, relatively inexpensive to manufacture, and which operates in a satisfactory manner in terms of safety.

Such a motor may be characterized, according to one aspect of the invention, in that it comprises:

- a toothed wheel turning continuously with the rotor,
- a worm, mobile between a clutch disengagement position and a clutch engagement position where the rotation of the worm drives the toothed wheel in a non-reversible manner.

Another object of the invention, according to another aspect, is a motor equipped with an auxiliary driving system comprising:

- a casing,
- a toothed wheel permanently rotating during the normal operation of the motor with the rotor inside the casing,
- a worm which may be brought into a clutch engagement position where the worm meshes with the toothed wheel and where the rotation of the worm drives the toothed wheel in a non-reversible manner and which may be withdrawn from that position, in order to allow the normal operation of the motor,
- a driving member for manually rotating the worm, the driving member rotating around the same rotation axis as the worm and rotating the latter by direct engagement.

The worm may be mobile inside the casing between the clutch engagement position and a clutch disengagement position.

The worm may, in certain embodiments of the invention, be completely removable from the casing to allow the normal operation of the motor.

The worm may be united with the driving member when it is brought into the clutch engagement position.

The motor may comprise a plate united with the worm, this plate may be fixed on the casing to axially immobilize the worm while allowing its rotation relative to the casing. The plate may be fixed by bolting on the casing. The worm may support a bearing guiding the worm in its rotation in relation to the casing.

The motor may comprise a bushing attached to the casing, in which the worm engages at an end opposite the driving member.

The casing may comprise two posts monolithically cast with the rest of the casing, these posts being traversed by the worm, the threaded portion of the worm extending between the posts. The worm may have a widened cylindrical portion between the threaded portion and the driving member, this widened portion bearing radially against a bore of one of the posts of the casing. The bushing may be bearing in a bore of the other post. The two bores of the two posts preferably have the same diameter. Thus, the bushing may be mounted indifferently on either side of the motor, so as to have the driving member on the side which suits the installation of the motor. The driving member may advantageously be mounted to the right or left of the motor.

The casing may have two opposite openings, in order to allow the mounting of the worm through either of the openings. These openings may be symmetrical in relation to a median plane of the casing. The opening of the casing opposite the opening for introduction of the worm may receive the above-mentioned bush, to compensate for the diameter of the worm.

In certain embodiments of the invention, the motor may comprise a lever for locking the worm in clutch disengagement position and in clutch engagement position.

The rotor may drive, without downshifting, an elevator cable drive pulley.

"Driving in a non-reversible manner" means that the rotation of the worm may drive that of the toothed wheel, but the rotation of the toothed wheel does not make it possible to drive the worm in rotation, due to friction forces.

Thus, once the worm is coupled to the toothed wheel, the brake may be unblocked if necessary without fearing an undesirable movement of the car under the effect of its weight, for instance. The rotation of the worm, once coupled to the toothed wheel, may also be done with the brake kept in braking configuration, for example in the case of an individual elevator.

The motor may comprise a electromagnetic brake.

The motor may comprise a safety system prohibiting unlocking of the brake in the absence of coupling of the worm and the toothed wheel. The unlocking of the brake may be necessary for collective elevators, for example.

The worm may be fixed to any manual driving member, for example a crank or a handwheel.

In certain embodiments of the invention, the passage of the worm between the clutch engagement position and the clutch disengagement position may be done through axial movement of the worm.

The safety system may comprise a blocking member of the brake, configured to prevent the unlocking of the brake in the absence of coupling of the worm and the toothed wheel.

In one embodiment of the invention, the worm comprises a groove and the blocking member of the brake may be position itself opposite that groove when the worm is coupled with the toothed wheel, the groove allowing the retreat of the blocking member of the brake during the unlocking maneuver of the brake and allowing the unlocking of the brake.

The auxiliary driving system may comprise a lever for locking the worm in either the clutch disengagement position or the clutch engagement position.

The driving system may comprise a safety bolt configured to immobilize the locking lever of the worm in locked position, the actuation of this bolt allowing the passage of the locking lever to the unlocked position, which allows a movement of the worm between its clutch engagement and clutch disengagement positions.

The safety bolt may be configured to act, when unlocked, i.e. when it allows the movement of the lever for locking the worm, on the blocking member of the brake so as to prevent unlocking of the brake.

The safety bolt may be kept in unlocked position by the locking lever, as long as the latter part is not in a locking position of the worm. The safety bolt, when locked, no longer acts on the blocking member of the brake, and the blocking member of the brake may move if the worm allows it.

The safety bolt may be able to be actuated manually.

The locking lever of the worm may comprise a fork engaging on the worm when the locking lever is in locking position and the worm is in one of the clutch engagement or clutch disengagement positions.

When the worm is not in one of the clutch engagement or disengagement positions, the locking lever may be prevented from assuming its locking position.

In one embodiment, the worm comprises a first groove in which the fork engages when the worm is in its clutch disengagement position and a second groove in which the fork engages with the worm is in its clutch engagement position, the first groove allowing the retreat of the blocking member from the brake in order to allow the unlocking of the brake.

The locking lever may be movable in rotation in a first direction to go from the locking position to the unlocking position and may comprise an actuating arm of the brake, this arm being articulated on the locking lever and being able to pivot in a second direction opposite the first.

The actuating arm of the brake may be arranged in relation to the locking lever so as to allow the user having grasped a handle situated at the end of the arm, to drive the locking lever in rotation when moved in the first direction above.

A control cable transmission system may be mounted between the brake and the locking lever, such that the rotation of the arm acts on the brake in order to unblock the latter part, when such an unlocking is authorized, i.e. in particular when the worm is in the clutch engagement position.

The driving system may comprise a drive lever of a mobile armature of the brake, this drive lever being actuated by the above cable when the arm is moved in rotation relative to the locking lever of the worm.

The drive lever may be configured such that its pivoting moves the mobile armature in the direction of an unlocking of the brake.

The aforementioned blocking member may be arranged to act on the drive lever in order to oppose its movement leading to the unlocking of the brake.

The motor may drive an elevator car, the driving being done for example directly, without reduction gear of the rotational speed of the rotor.

The drive pulley driving the cables of the car and of the counterweight of the elevator may be fixed on the motor shaft.

Another object of the invention is a method for driving a motor as defined above, comprising the steps of:

acting on the worm to couple it to the toothed wheel, driving the worm in rotation to drive the motor.

The worm may in particular be rotated manually.

The worm may be rotated against the braking action of the brake.

Alternatively, the worm may be rotated with the brake unblocked. The worm may be removable.

Figure 2:
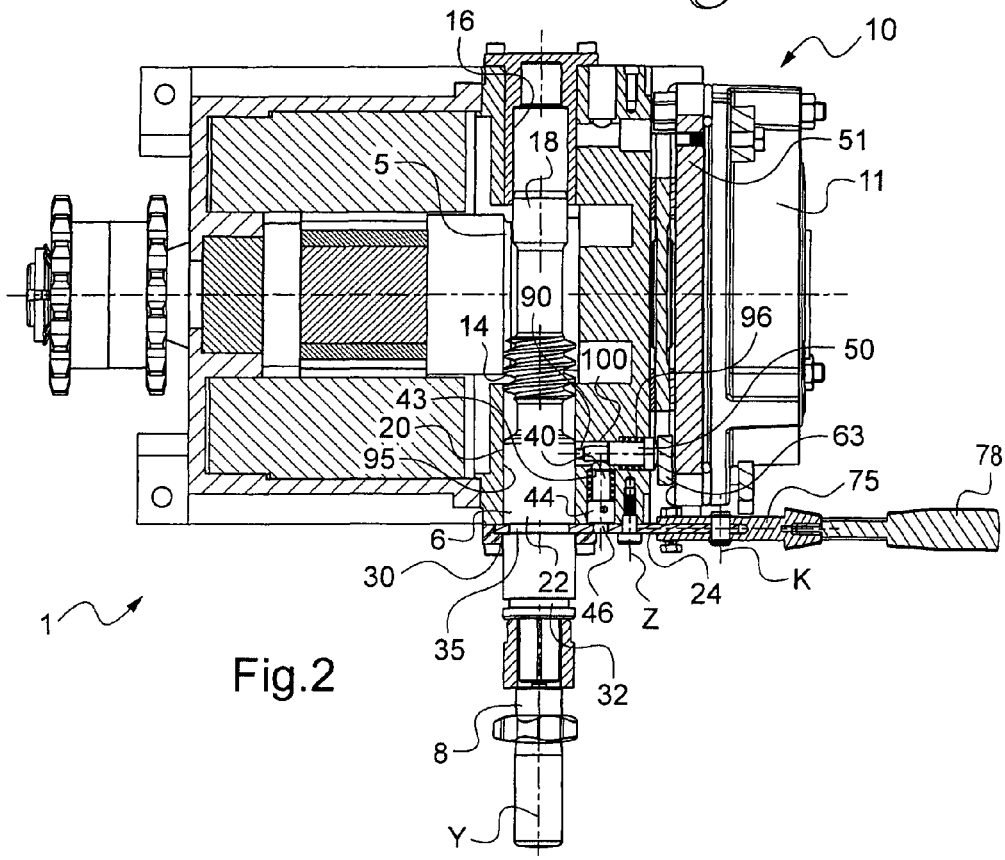
Figure 3:
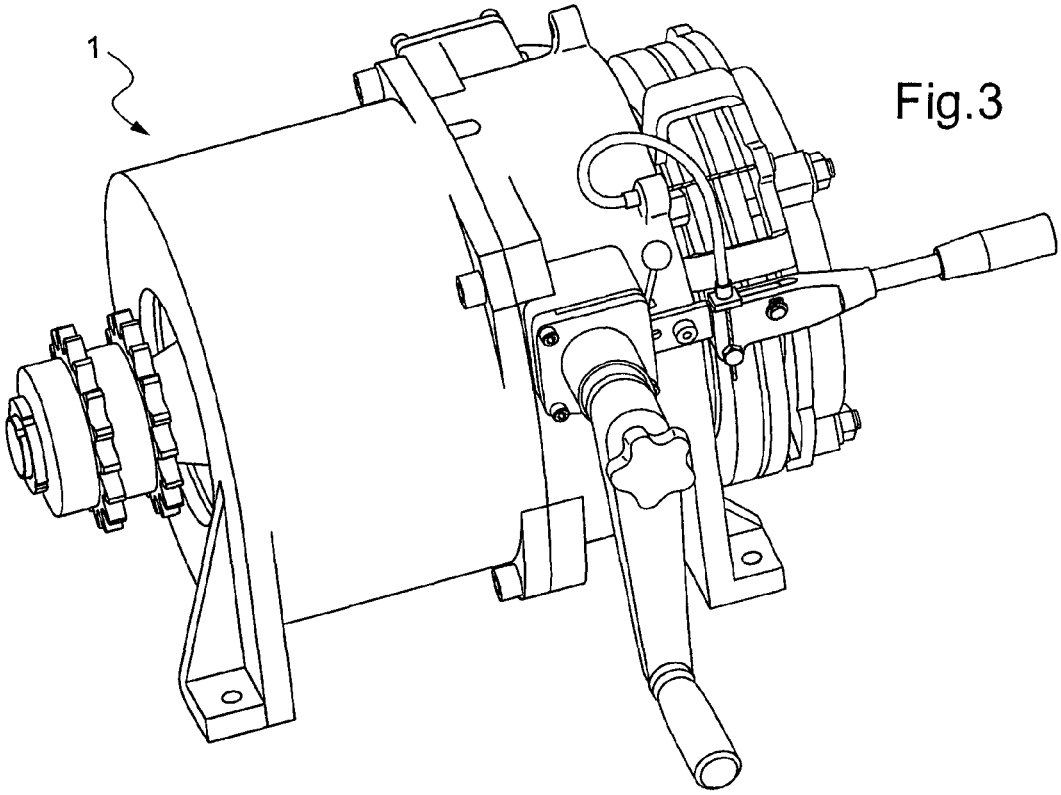
Figure 4:
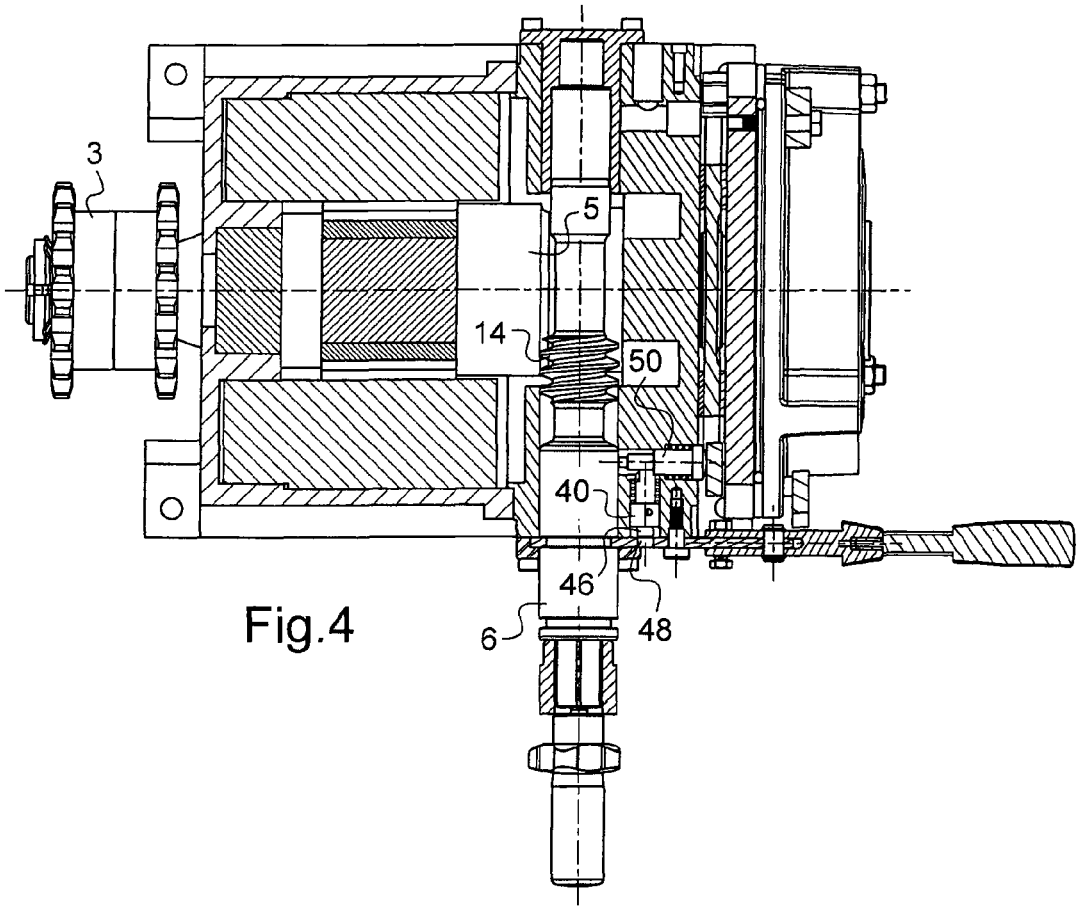
Figure 5:
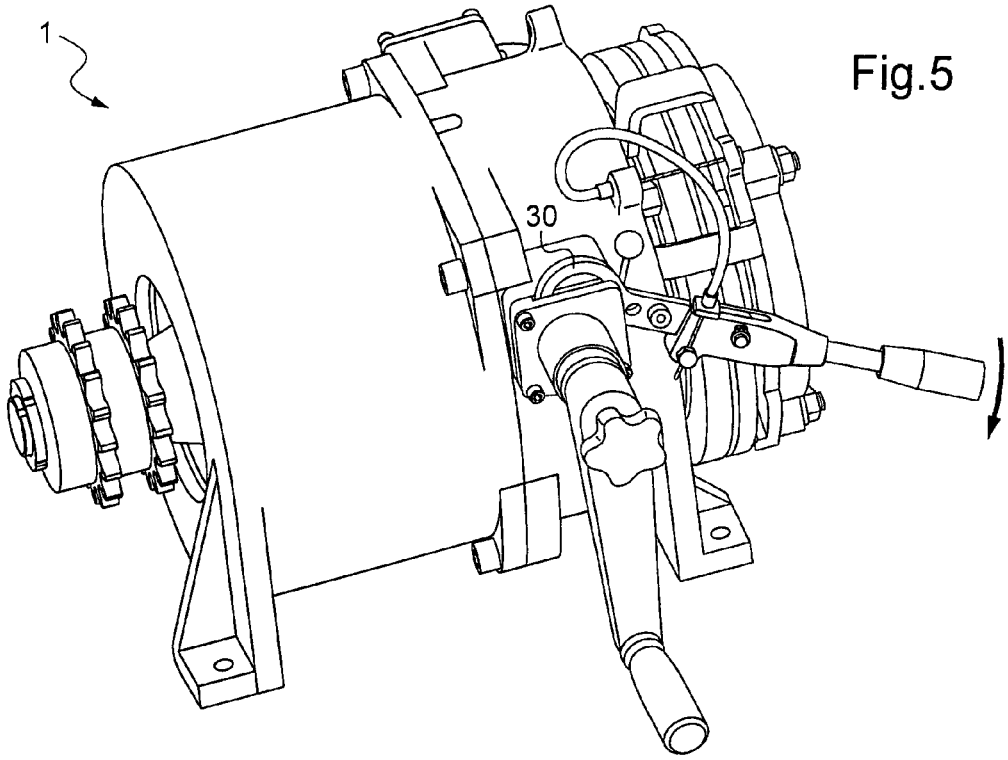
Figure 6:
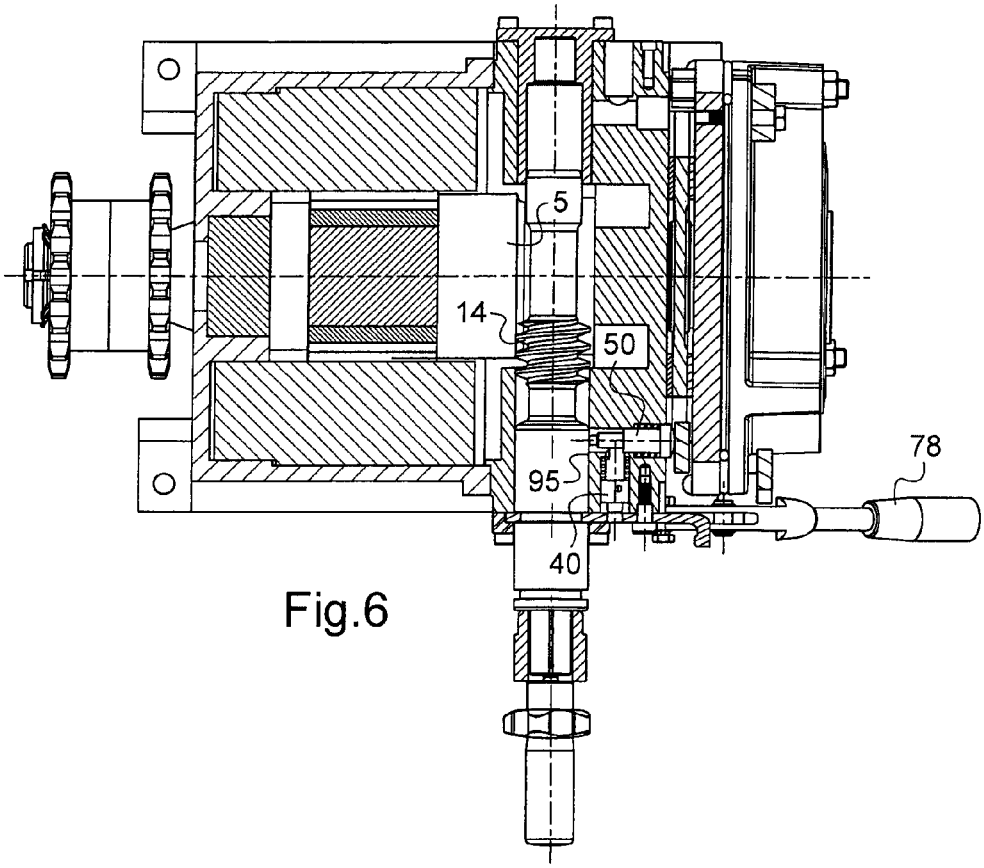
Figure 7:
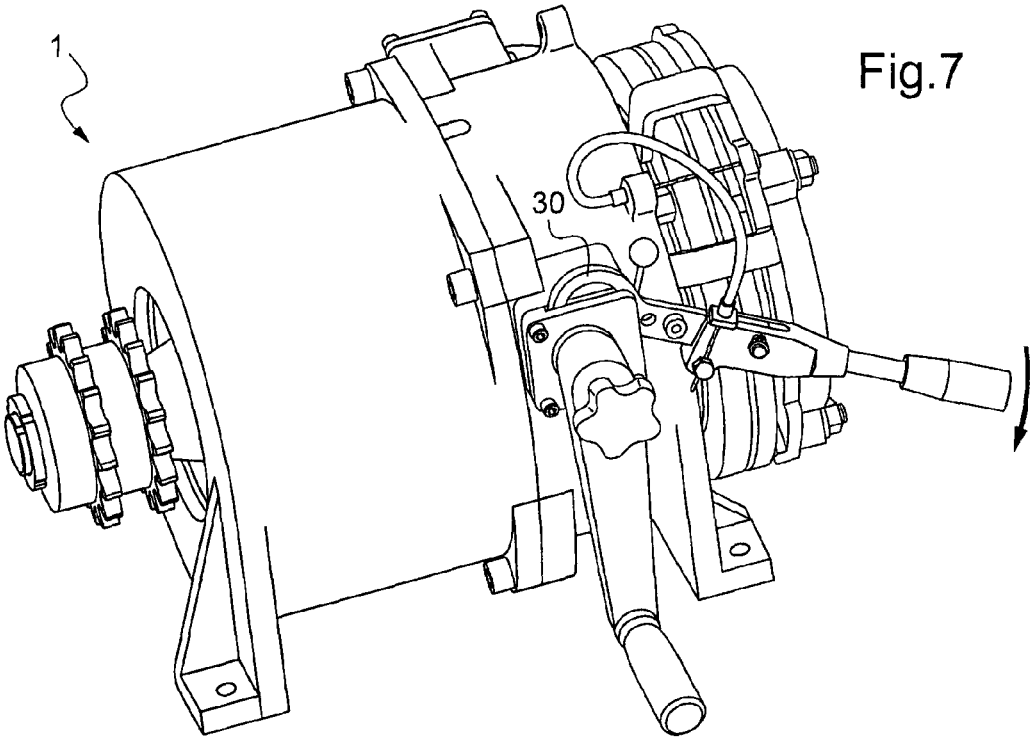
Figure 8:
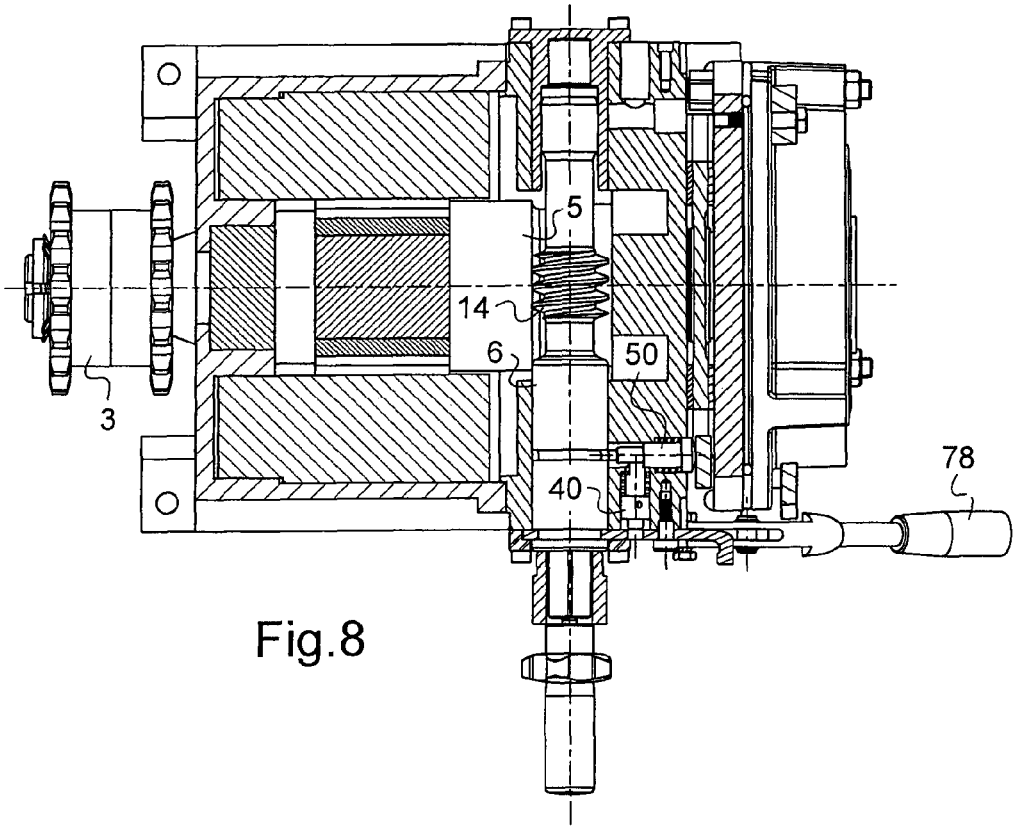
Figure 9:
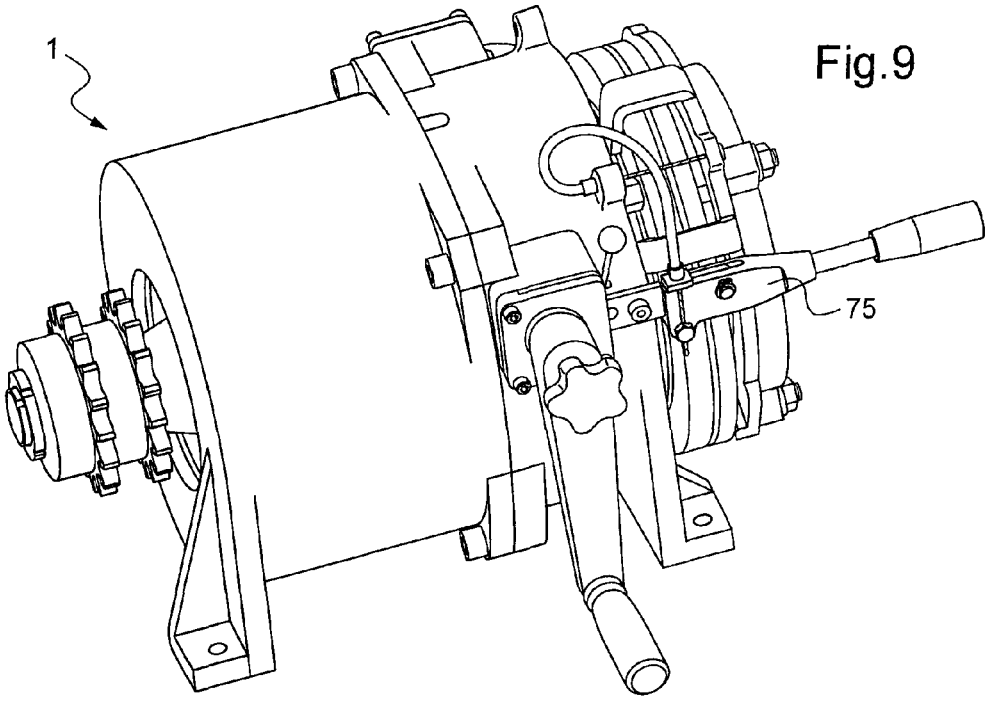
Figure 10:
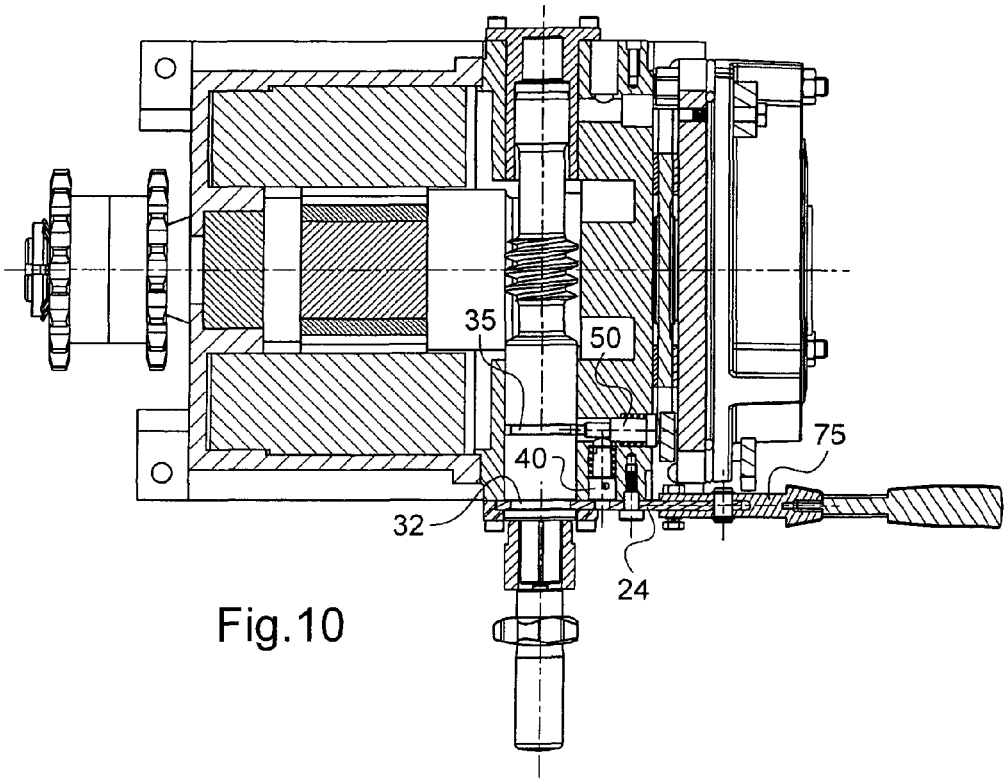
Figure 11:
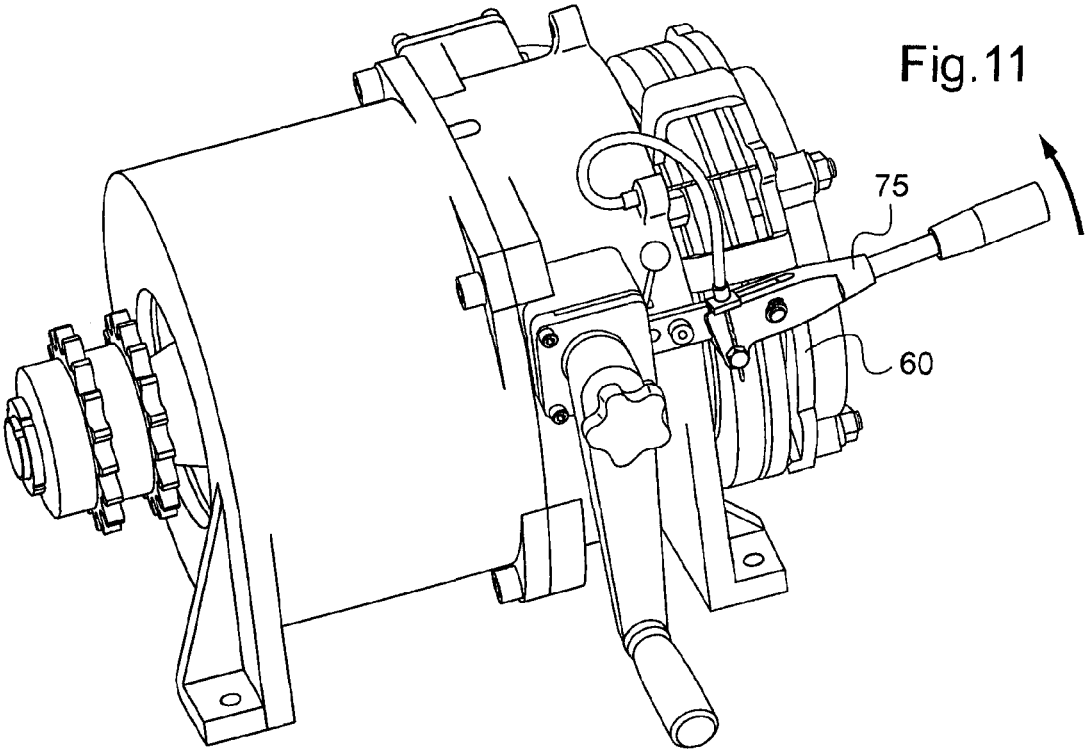
Figure 12:
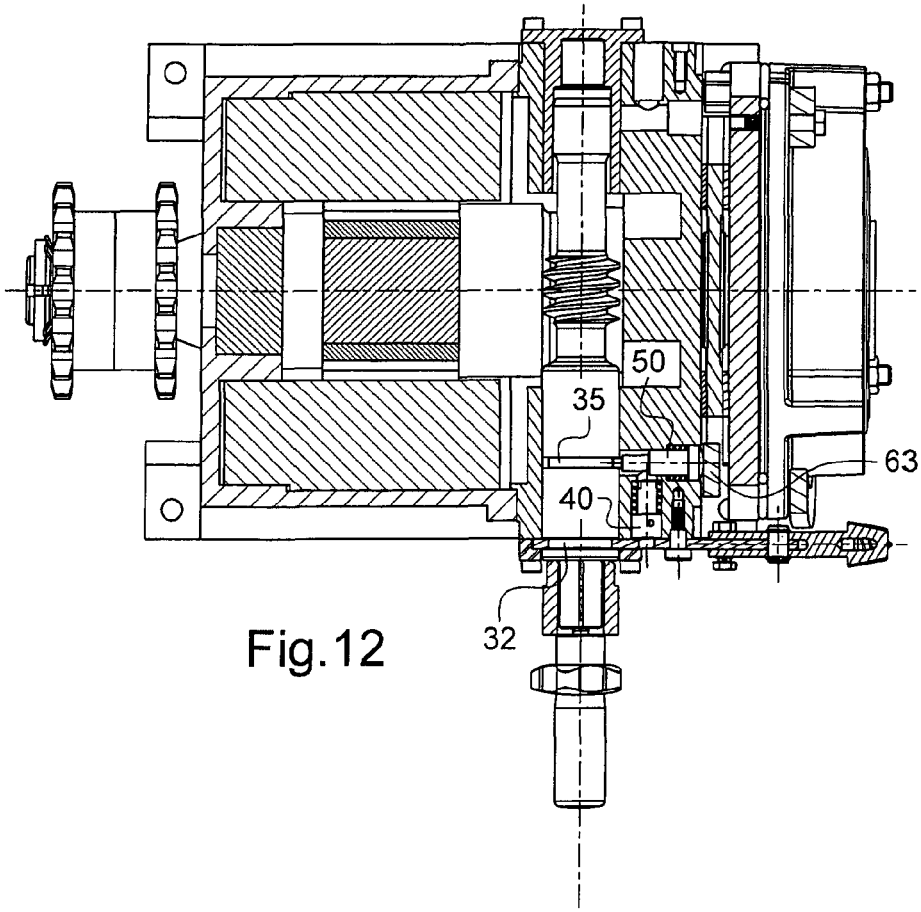
Figure 13:
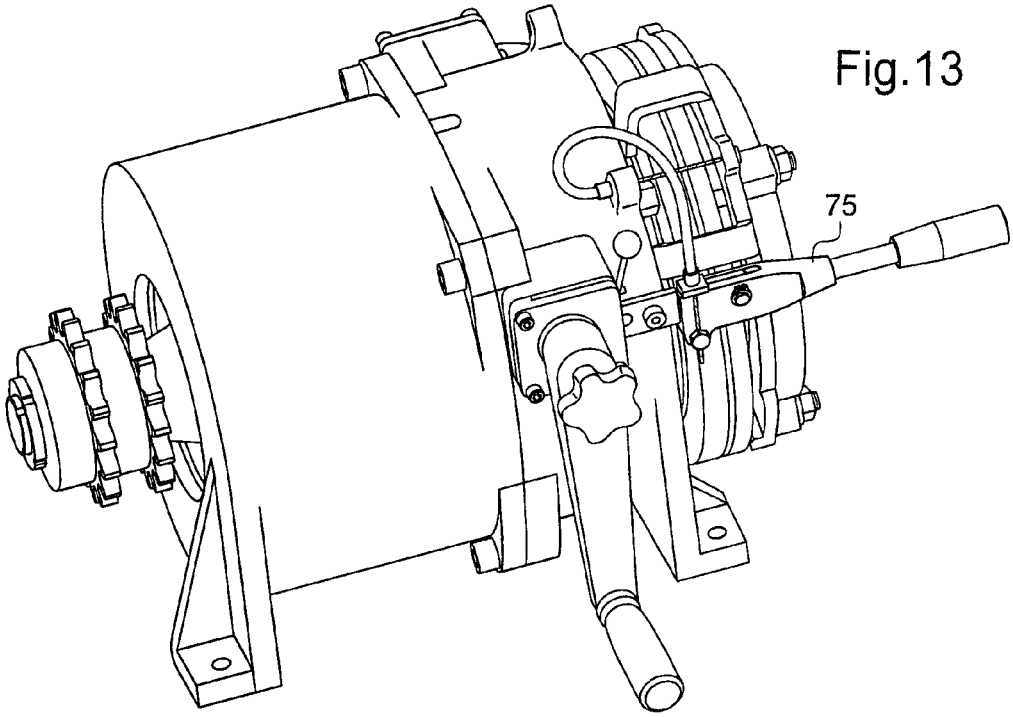
Figure 14:
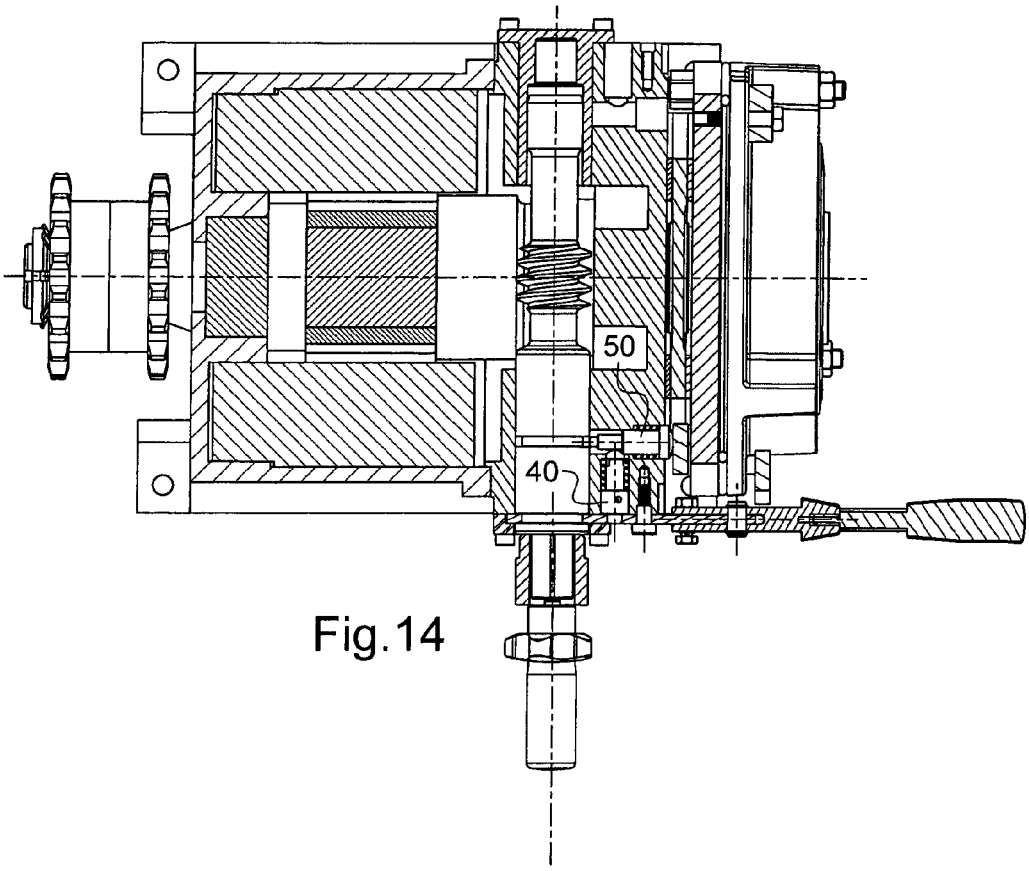
Figure 15:
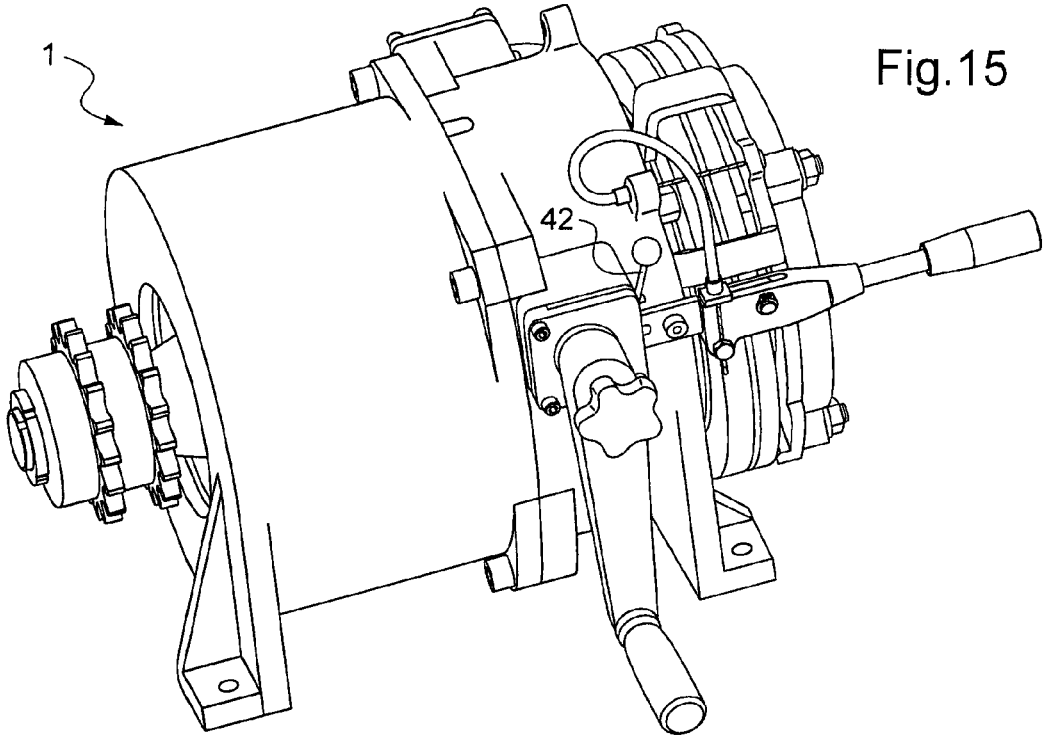
Figure 16:
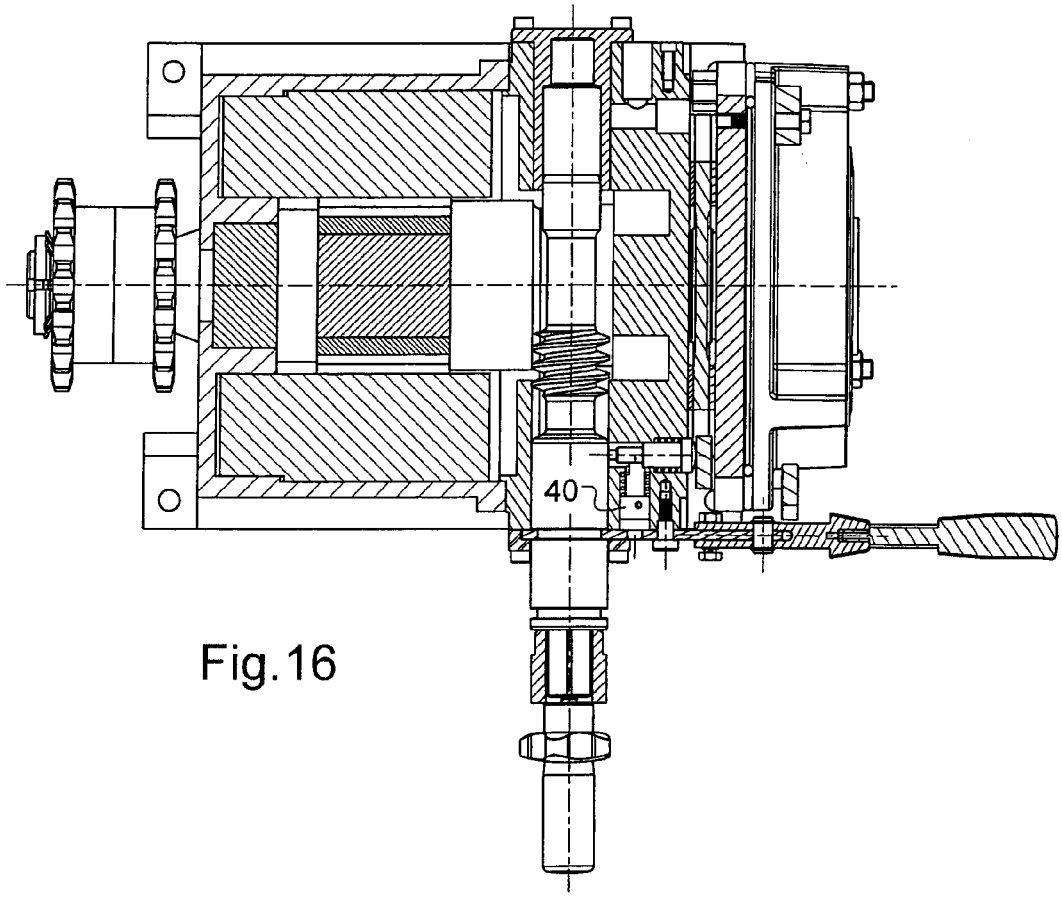
Figure 17:
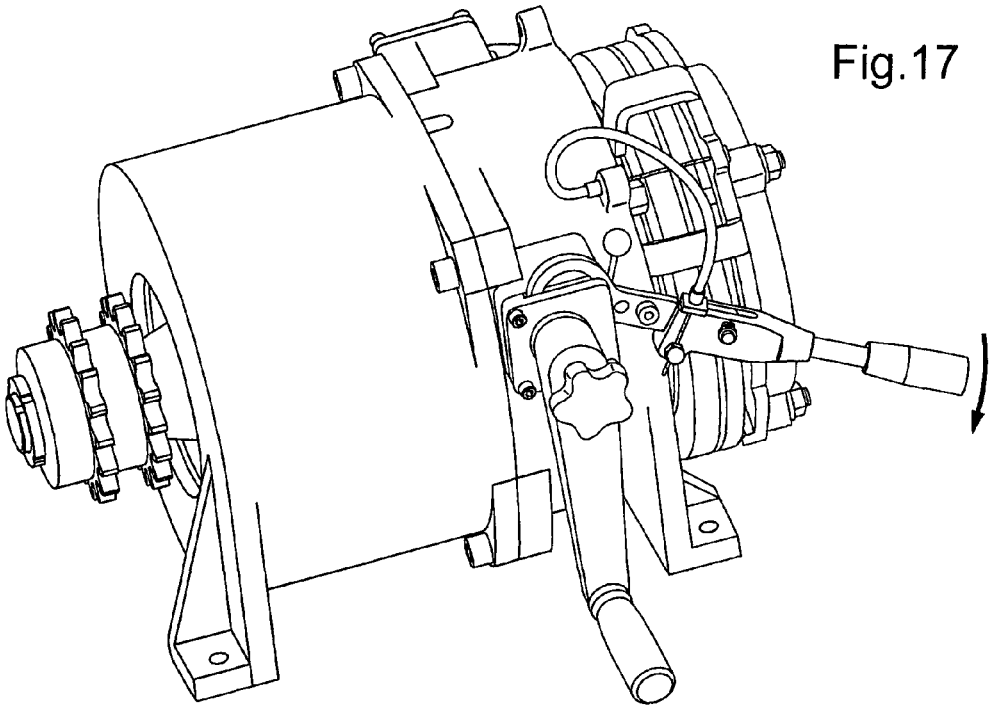
Figure 18:
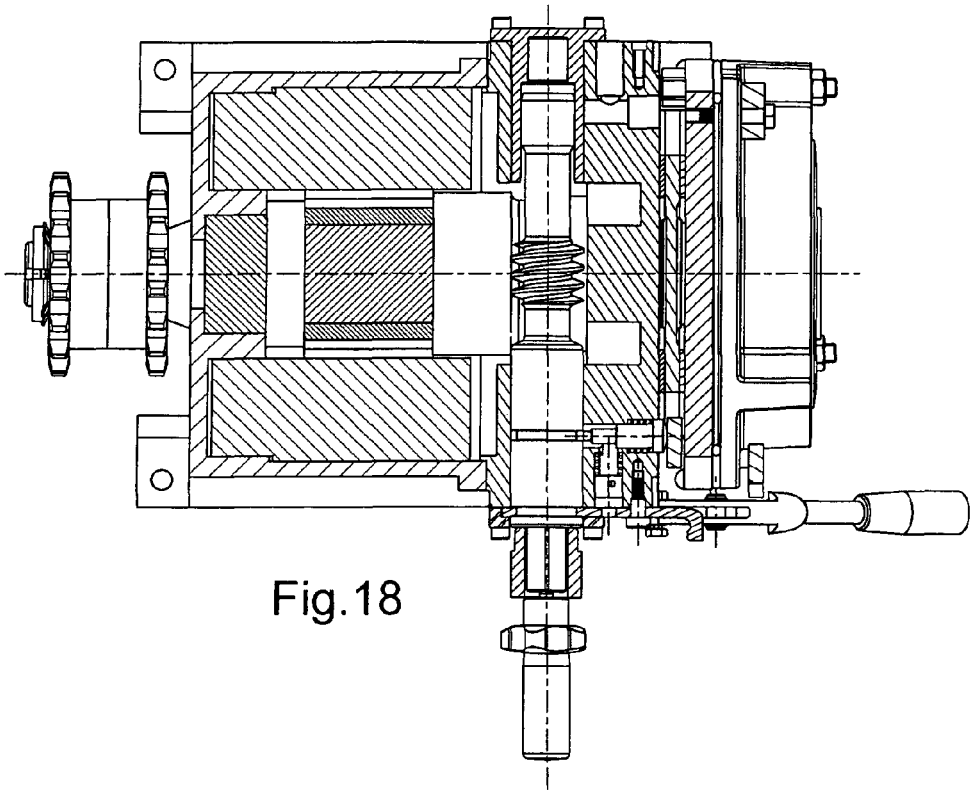
Figure 19:
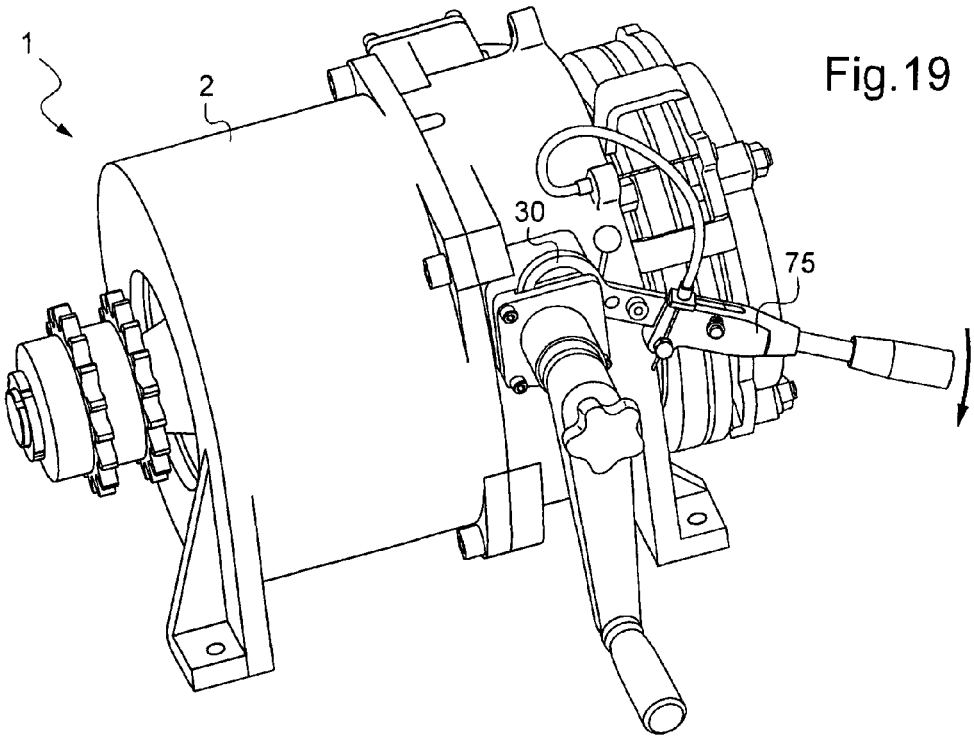
Figure 20:
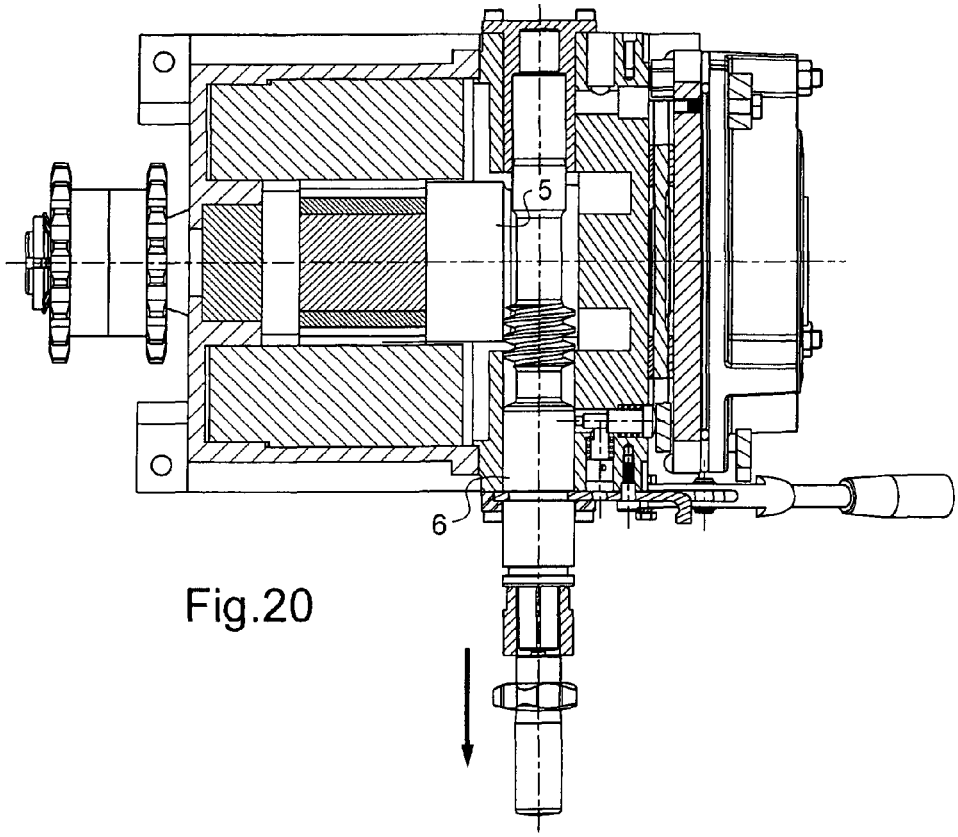
Figure 21:
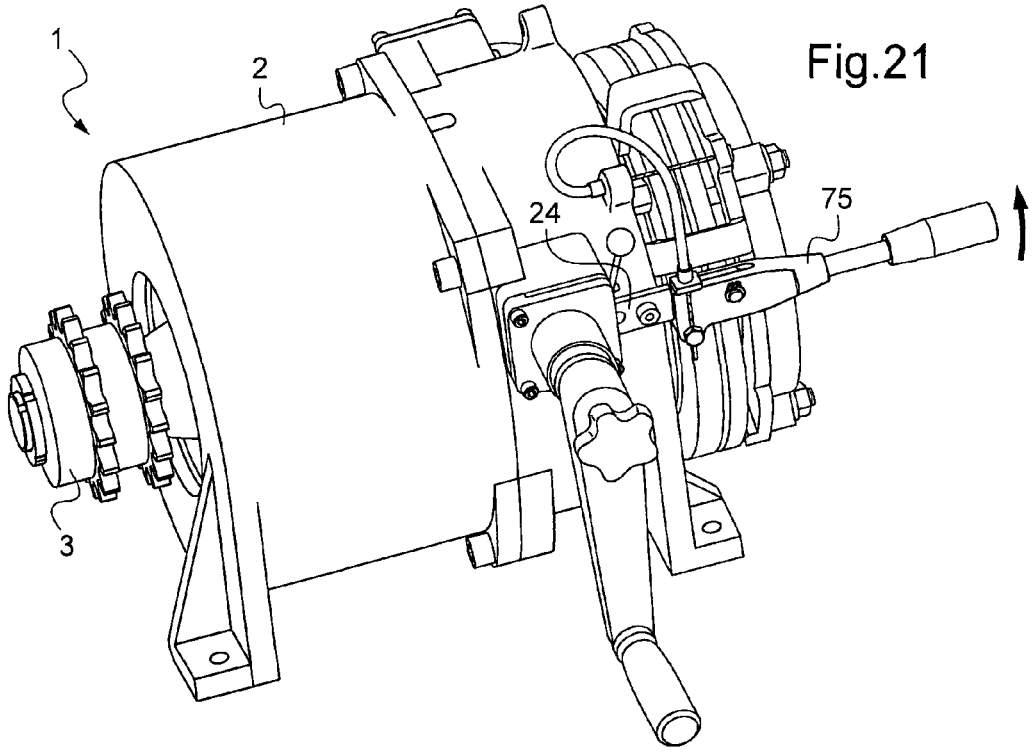
Figure 22:
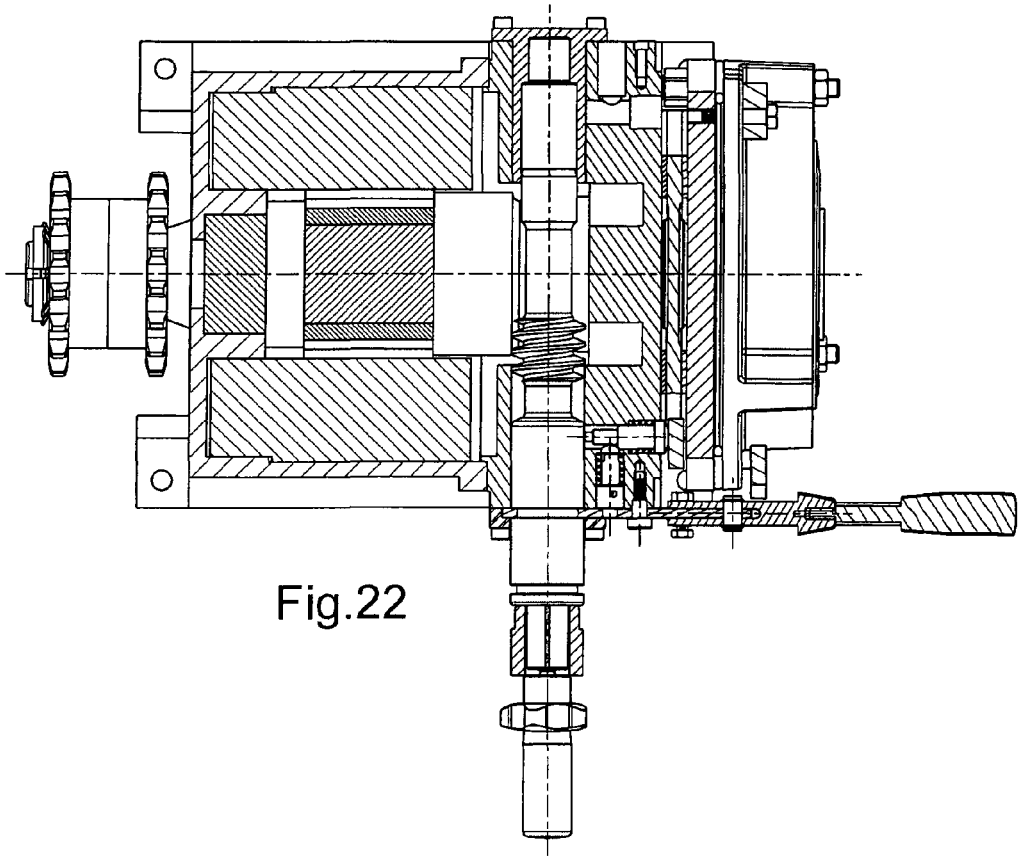
Figure 23:
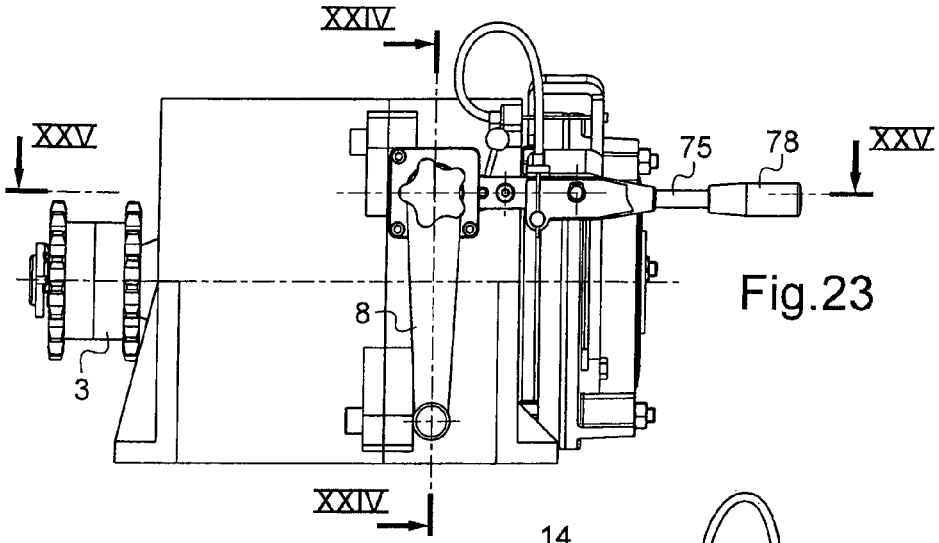
Figure 24:
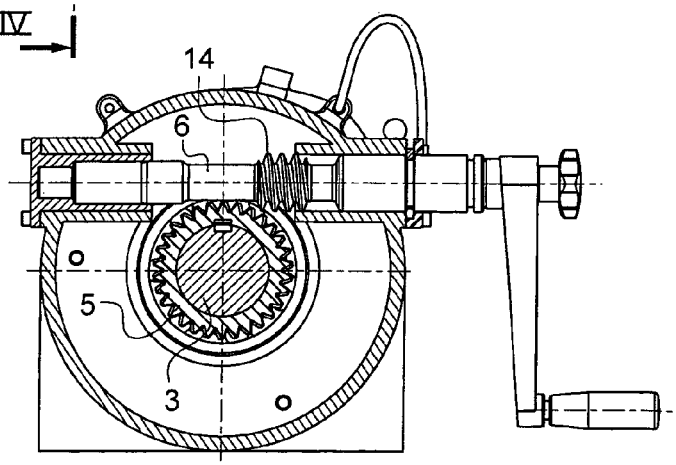
Figure 25:
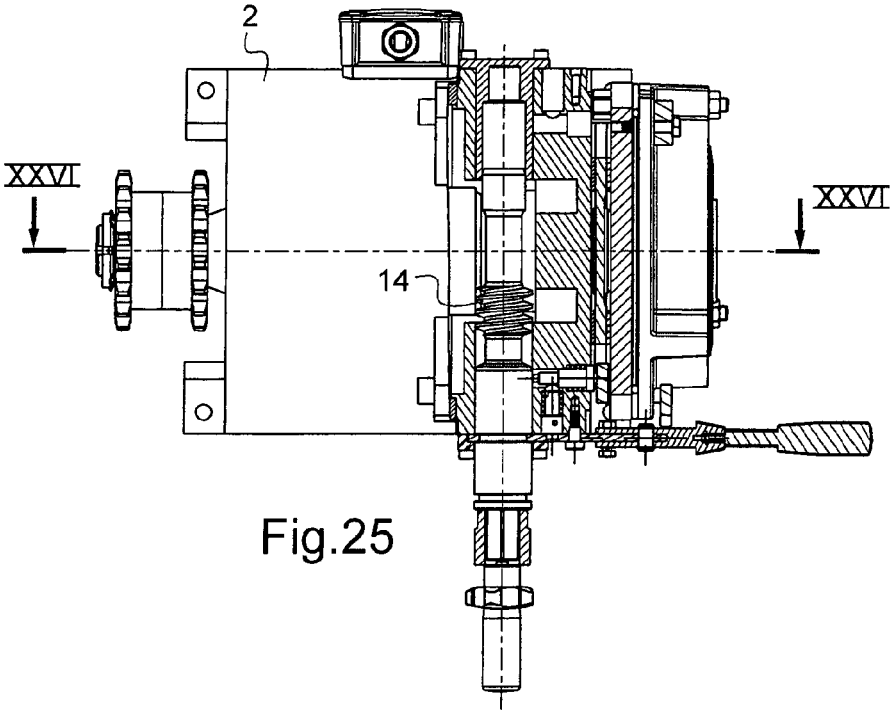
Figure 26:
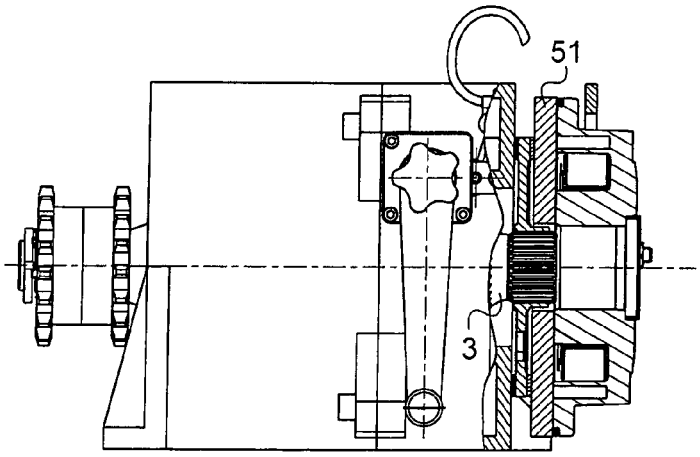
Figure 27:
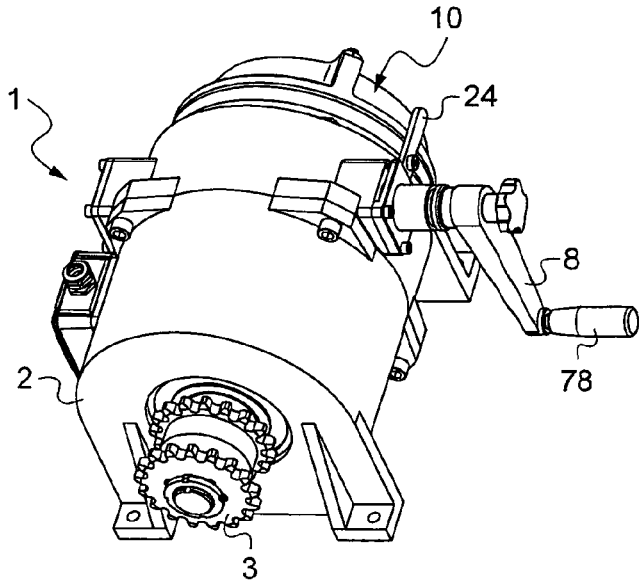
Figure 28:
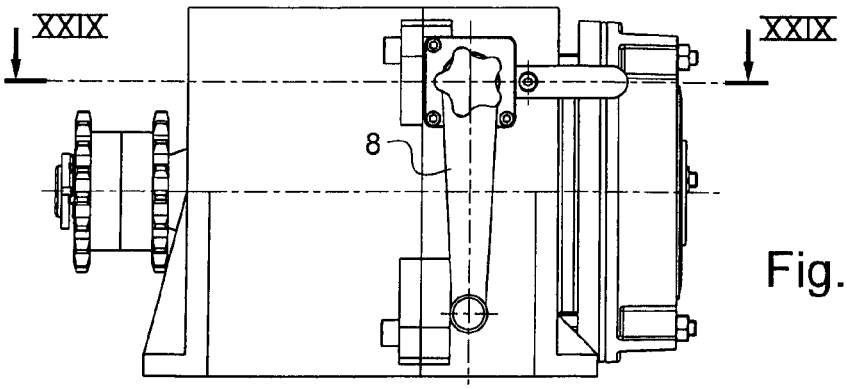
Figure 32:
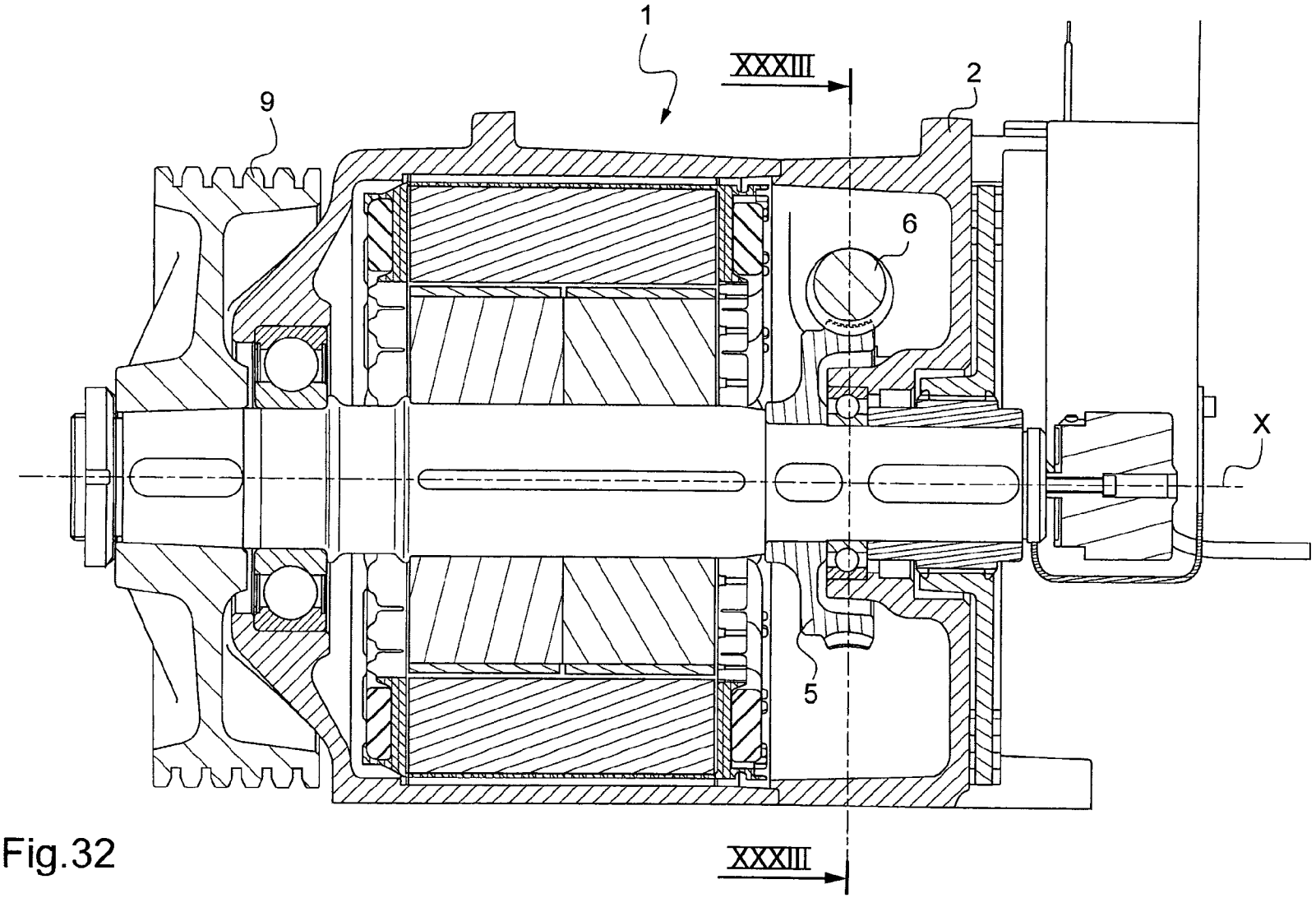
Figure 33:
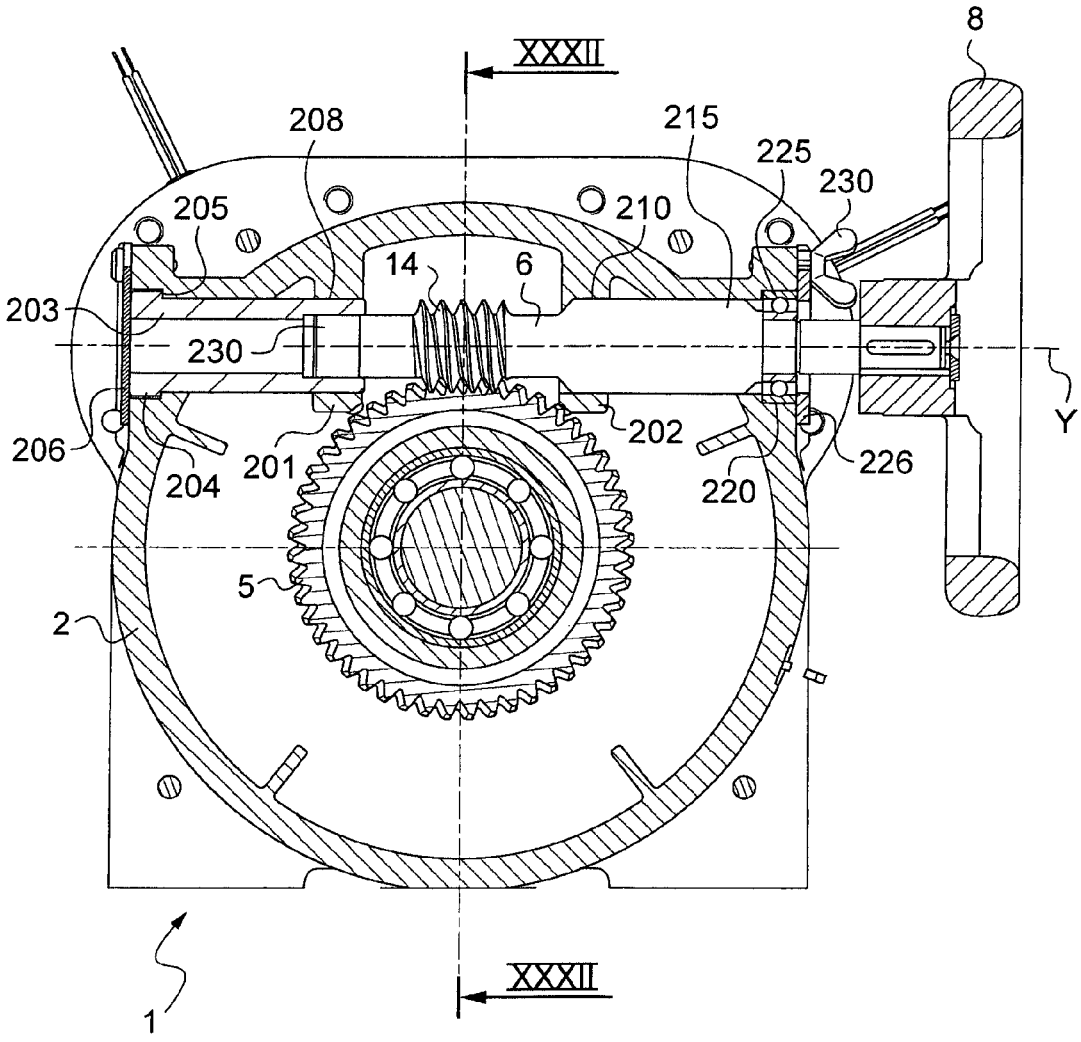

The invention may be better understood upon reading the detailed description which follows, of non-limiting embodiments thereof, and upon examining the appended drawing, in which:

FIG. 1 diagrammatically illustrates, in perspective view, an embodiment of a motor realized according to the invention, in a normal operating configuration, after loss of electrical power, FIG. 2 is an axial diagrammatic and partial cross-section of the motor of FIG. 1, FIG. 3 is a view similar to FIG. 1 of the motor, after release of the safety bolt, FIG. 4 is an axial cross-section of the motor in the configuration of FIG. 3, FIG. 5 is a view similar to FIG. 1, after unlocking of the worm, FIG. 6 is an axial cross-section of FIG. 5, FIG. 7 is a view similar to FIG. 1, after coupling of the worm with the toothed wheel, FIG. 8 is an axial cross-section of FIG. 7, FIG. 9 is a view similar to FIG. 1, after locking of the worm in the clutch engagement position, FIG. 10 is an axial cross-section of FIG. 9, FIG. 11 illustrates the manual unlocking of the brake, FIG. 12 is an axial cross-section of FIG. 11, FIG. 13 is a view similar to FIG. 1, illustrating the motor at the end of the manual maneuver, FIG. 14 is an axial cross-section of FIG. 13, FIG. 15 illustrates the disengagement of the safety bolt, allowing the movement of the locking lever, FIG. 16 is an axial cross-section of FIG. 15, FIG. 17 illustrates the unlocking of the worm, after rotation of the locking lever, FIG. 18 is an axial cross-section of FIG. 17, FIG. 19 is a view similar to FIG. 1, after disengaging of the worm, FIG. 20 is an axial cross-section of FIG. 19, FIG. 21 is a view similar to FIG. 1, illustrating the locking of the worm, FIG. 22 is an axial cross-section of FIG. 21, FIG. 23 is a side view of the motor, FIG. 24 is a transverse cross-section along XXIV-XXIV of FIG. 23, FIG. 25 is a longitudinal cross-section along XXV-XXV of FIG. 23, and FIG. 26 is an axial cross-section along XXVI-XXVI of FIG. 25, FIG. 27 illustrates a perspective view of an alternative embodiment of the motor, FIG. 28 is a side view of the motor of FIG. 27, FIG. 29 is a longitudinal cross-section along XXIX-XXIX of FIG. 28, FIG. 30 is a transverse cross-section along XXX-XXX of FIG. 29, FIG. 31 is an axial cross-section along XXXI-XXXI of FIG. 30, FIG. 32 is a diagrammatic longitudinal cross-section of a motor according to an alternative embodiment of the invention, and FIG. 33 is a diagrammatic transverse cross-section along XXXIII-XXXIII of FIG. 32.

The motor 1 illustrated in the figures comprises a casing 2 and a rotor 3 rotating in relation to the casing 2 around a rotation axis X.

In the illustrated embodiment the rotor 3 turns inside the stator, but the rotor could be outside the stator.

The rotor 3 may for example be of the type with permanent magnets and the stator 2 may be of the type with concentrated or distributed winding.

The motor 1 is continuously equipped with an integrated auxiliary driving system, comprising a toothed wheel 5 permanently rotating with the rotor 3 and a worm 6 which may be manually rotated by a crank 8 around a rotation axis Y, which is for example oriented perpendicularly to the axis X.

In the embodiment at hand, the motor 1 also comprises a electromagnetic brake 10, i.e. which assumes a braking configuration in the absence of electrical power.

Such a brake 10 traditionally comprises at least one electromagnet 11, a mobile armature 51, able to move in translation against the action of at least one elastic return member, under the effect of the magnetic field produced by the electromagnet 11. The mobile armature 51 may press against a or braking surface when the electromagnet 11 is no longer powered, under the effect of the elastic return member, so as to block and/or brake the rotor 3.

The worm 6 may assume a clutch disengagement configuration, illustrated in FIG. 2, in which it does not mesh with the toothed wheel 5, and a clutch engagement configuration, illustrated in FIG. 8, in which its threading 14 meshes with the toothed wheel 5.

The threading 14 and the toothing of the toothed wheel 5 are arranged such that the transmission of the movement is irreversible, i.e. the rotation of the toothed wheel does not cause the rotation of the worm 6 whereas the rotation of the latter part is accompanied by the rotation of the toothed wheel 5.

In the illustrated embodiment, the worm 6 may go from the clutch engagement position to the clutch disengagement position through a movement along the axis Y, the worm 6 being guided in this movement both by a bore 16 of the casing in which its end 18 opposite the crank 8 is engaged, and by a bore 20 of the casing, this bore 20 being in contact with a portion 22 of the worm 6 adjacent to the crank 8.

The motor 1 comprises a lever 24 for locking the worm 6 in the clutch disengagement position, illustrated in FIG. 2, and in the clutch engagement position, illustrated in FIG. 8.

The locking lever 24 is articulated in the illustrated embodiment on the casing around an axis Z parallel to the axis Y, and comprises a fork 30 at its end, arranged to engage either in a first groove 32 of the worm 6 when the latter part is in the clutch engagement position, as illustrated in FIG. 8, or in a second groove 35 when the worm 6 is in the clutch disengagement position, as illustrated in FIG. 2.

A safety bolt 40 makes it possible to immobilize the locking lever 24 in a locking position of the worm where the fork 30 is engaged in one or the other of the grooves 32 and 35.

The safety bolt 40 may be moved manually by the user, in the considered embodiment, using a safety lever 42.

The movement of the safety bolt 40 is done in the illustrated embodiment in translation parallel to the axis Z, against the return action of a spring 43, in a housing 44 of the casing.

The safety bolt 40 comprises a relief 46, for example a lug, which may engage in a corresponding relief 48, for example a hole, of the locking lever 24 when the latter part is in the locking position.

The locking lever 24 is thus maintained by the safety bolt 40 in the locking position and may only be unlocked after a prior action on the safety lever 42 to cause the safety bolt 40 to retreat into its housing and disengage the bolt 46 from the hole 48.

The motor comprises a drive lever 60 which is mobile in relation to a cylinder head 65 of the brake between an inactive position where this drive lever 60 does not prevent the mobile armature 51 from being in the braking position, as illustrated in FIG. 2, and an active position in which the mobile armature 51 is remote from the braking surface, as illustrated in FIG. 12.

The drive lever 60 is articulated on the brake around an axis W, for example owing to a portion 62 semi-annular in shape, and comprises tabs 63 configured to bear on the mobile armature 51 when the drive lever is stressed in rotation.

The locking lever 24 supports an arm 75 articulated on the lever around an axis K parallel to the axis Z, this arm 75 being provided at one end with a handle 78 and at the other end comprising a stud 79 serving for hitching of a core 80 of a control cable (also called Bowden® cable), the other end of the core 80 of this control cable being connected to the drive lever 60, for example to the portion 62 of the side of the tabs 63 and between them.

The sheath 82 of the control cable is fixed at one end on the locking lever 24 and at the other end on the casing 2 of the motor.

A blocking member 50 is provided to prevent the movement of the drive lever 60 when the worm 6 is not in the clutch engagement position.

A stop 79 formed on the lever 24, and against which the arm 75 bears when it extends along the axis of the locking lever 24, enables the arm 75 only to pivot upward relative to the locking lever 24 and makes it possible to use the handle 78 to move the lever 24 downward.

The blocking member 50 comprises one end 90 which may bear axially against a surface 95 of the worm 6, such that its retreat is prevented. The blocking member 50 is stressed in the direction opposing the worm 6 by a spring 96 and may bear against a tab 63 of the drive lever 60.

The housing 100 receiving the blocking member 50 communicates with the housing 44 receiving the safety bolt 40, such that the safety bolt 40 may retreat into the housing 100 and present an obstacle to the retreat of the blocking member 50 when the lug 46 is disengaged from the hole 48, as illustrated in FIG. 4.

This prohibits the unlocking of the brake as long as the locking lever 24 is not in the locking position.

The end 90 of the blocking member 50 may engage in the groove 35 when the latter is positioned in the extension of the blocking member 50, once the worm 6 reaches the clutch engagement configuration with the toothed wheel 5, as illustrated in FIG. 8.

During the normal operation of the motor, the locking lever 24 is in the locking position, the fork 30 being engaged in the groove in order to keep the worm 6 in the clutch disengagement configuration, as shown in FIGS. 1 and 2.

In this configuration, the blocking member 50 opposes any movement of the drive lever 60 in case of attempt to maneuver the arm 75 upward.

In case of electrical power outage, the brake assumes a blocking configuration.

To unblock the brake, the operator begins by acting on the safety lever in order to disengage the safety bolt 40 of the locking lever 24, as illustrated in FIGS. 3 and 4.

The retreat of the safety bolt 40 results in prohibiting the retreat of the blocking member 50.

The user may then, as illustrated in FIGS. 5 and 6, actuate the locking lever 24 downward, owing to the handle 78, so as to release the fork 30 from the groove 35.

Once this release is done, the user can, as illustrated in FIGS. 7 and 8, move the worm 6 along its axis Y so as to cause it to mesh with the toothed wheel 5.

When the worm 6 reaches its clutch engagement position, the groove 35 positions itself opposite the blocking member 50. The retreat of the latter part is, however, prevented by the safety bolt 40, which is kept engaged in the housing 100 of the blocking member 50 by the locking lever 24, as long as the latter is not returned to its locking position of the worm 6, as illustrated in FIGS. 9 and 10.

The return of the lever 24 to the locking position of the worm 6 allows the lug 46 of the safety bolt to again engage in the hole 48, which releases the blocking member 50 and enables the latter part to retreat into the groove 35 when the arm 75 is actuated to move the drive lever 60, as illustrated in FIGS. 11 and 12.

The movement of the arm 75 makes it possible to unblock the brake and the operator may then, while actuating the arm 75, turn the worm 6 owing to the crank 8, in order to cause the rotor to rotate and move, for example, the elevator car toward the closer floor in order to free the passengers.

The connection between the wheel 5 and the worm 6 being irreversible, there is no fear of the rotor rotating in the wrong direction, since in case of release of the crank 8, the worm 6 immobilizes the rotor in rotation.

Once the rotation of the rotor is done, the user may return the motor to its normal operating configuration by releasing the arm 75 to again block the brake, as illustrated in FIGS. 13 and 14, then by acting on the safety lever 42 so as to move the safety bolt 40 and allow the downward rotation of the locking lever 24, as illustrated in FIGS. 15 to 18.

Once the fork 30 is released from the groove 32, the worm 6 may be moved toward its disengaged position, the brake being prevented from being unblocked by the safety bolt 40 engaged in the housing 100 of the blocking member 50.

The retreat of the blocking member 50 is prevented by the worm 6 when the latter part is brought into its disengaged position, as illustrated in FIGS. 19 and 20.

The locking lever 24 may then be returned to its locking position of the worm 6, the fork 30 engaging in the groove 35, which permits the safety bolt 40 to resume its place, as illustrated in FIGS. 21 and 22.

The invention is not limited to the embodiment just described. In the alternative illustrated in FIGS. 37 to 31, the auxiliary driving system does not comprise unlocking means of the brake but simply permits movement of the worm between the clutch engagement and clutch disengagement positions.

In the clutch engagement position, the worm drives the rotor in rotation whereas the brake remains in the blocking configuration, the torque generated by the rotation of the worm being sufficient to cause the rotation of the rotor despite the resistance of the brake. A locking lever 24 of the worm 6 is provided, without safety system as described previously, comprising the fork 30.

Various modifications may be made to the embodiments just described.

In the illustrated embodiments the worm is driven manually, but this driving could be done in alternative embodiments by a small electric motor powered by a battery backup.

Likewise, the unlocking of the brake could be done not through a manual action, but by a servomechanism powered by such a battery backup.

The unlocking of the brake could also be done electrically by powering the brake.

The worm may be brought from the clutch disengagement position to the clutch engagement position by a movement other than a movement along an axis Y, for example by a more complex movement in which the worm would be moved with a movement comprising a component perpendicular to its longitudinal axis.

The motor illustrated in FIGS. 32 and 33 differs from what has been previously described in reference to FIGS. 1 to 31 by the fact that the worm may be entirely loosened from the motor during the normal operation thereof.

The worm is placed according to a clutch engagement position illustrated in FIG. 33 when the rotor must be driven manually.

An elevator cable drive pulley 9 is fixed on the motor shaft.

The casing 2 houses a toothed wheel rotating with the rotor shaft, like the embodiments previously described. In the embodiment of FIGS. 32 and 33, the casing is realized with two posts 201 and 202 which may be cast with the rest of the casing, between which the threaded portion 14 of the worm 6 extends when the latter is in its clutch engagement position.

The casing receives a bushing 203 which defines the housing in which the end of the worm 6 opposite the driving member 8 is received. This bushing 203 for example comprises a flange 204 at one end which bears against a shoulder 205 of the casing. The flange 204 may be kept bearing against the shoulder 205 by a closing plate 206, which is for example bolted on the casing. The bushing 203 bears radially, in the embodiment at hand, in a bore 208 of the post 201. The other post 202 has a bore 210 against which an enlarged portion 215 of the worm may bear, extending between the threaded portion 14 and the driving member 8.

In the embodiment at hand, the driving member 8 assumes the form of a handwheel which rotates around the same rotation axis Y as the worm 6.

The opening of the casing situated on the side of the driving member 8 has a stepped portion 220 which may accommodate a bearing 225 making it possible to guide the worm 6 in rotation relative to the casing.

The worm 6 may be axially immobilized relative to the casing 6 by a plate 226, which is for example bolted on the casing using wing nuts 230 to facilitate the assembly and disassembly of the plate 226.

The bearing 225 permits the plate 226 to axially immobilize the worm 6 without, however, braking its rotation.

The bushing 203 may alternatively be positioned on the side of the stepped portion 220, the casing 2 being symmetrical in relation to a median plane regarding the posts 201 and 202 and the openings receiving the plates 206 and 226. The worm 6 may thus be mounted on either side.

When the worm 6 is removed from the casing, after withdrawal of the bolts 230, the plate 226 and the bearing 225 remain united with the worm 6.

To use the auxiliary driving system, in the embodiment of FIGS. 32 and 33, the user introduces the worm 6 into the casing so as to engage its end 230 in the bushing 203 and bolt the plate 226 on the casing. The user may have to rotate the worm 6 upon its placement due to the meshing of the threaded portion 14 on the toothed wheel.

In the embodiment of FIGS. 32 and 33 the driving is non-reversible, i.e. the worm may cause the toothed wheel to rotate and not vice versa.

The user may rotate the rotor without unlocking the brake and thus moving the car. Once the desired movement is obtained, the worm may be removed from the casing in order to allow the normal operation of the motor.

The invention is particularly suited to the driving of a motor rotor connected to an elevator car, but may be applied to other devices, for example a winch or a turret.

The expression "comprising a" must be understood as being synonymous with "comprising at least one", unless the contrary is specified.

The invention claimed is:

1. A motor equipped with an auxiliary driving system comprising:

a casing, a toothed wheel rotating with a rotor inside the casing during the normal operation of the motor;

a worm enabled to be brought into a clutch engagement position wherein the worm meshes with the toothed wheel and wherein rotation of the worm drives the toothed wheel in a non-reversible manner and enabled to be removed from the clutch engagement position to allow the normal operation of the motor;

a driving member configured to enable manual rotation of the worm by direct engagement, the driving member rotating around the same axis of rotation as the worm.

2. The motor according to claim 1, wherein the worm is moveable inside the casing between the clutch engagement position and a clutch disengagement position.

3. The motor according to claim 1, wherein the worm is removable from the casing to permit the normal operation of the motor.

4. The motor according to claim 3, wherein the worm is engaged with the driving member when it is brought into the clutch engagement position.

5. The motor according to claim 3, further comprising a plate engaged with the worm to axially immobilize the worm while enabling rotation of the worm relative to the casing.

6. The motor according to claim 5, wherein the plate is fixed by bolting on the casing.

7. The motor according to claim 1, wherein the worm supports a bearing guiding the worm in its rotation relative to the casing.

8. The motor according to claim 3, further comprising a bushing attached to the casing, the worm engaging the bushing at an end opposite the driving member.

9. The motor according to claim 3, wherein the casing comprises two posts monolithically cast with the rest of the casing, the two posts being traversed by the worm, the threaded portion of the worm extending between the two posts.

10. The motor according to claim 9, wherein the worm has a widened cylindrical portion between the threaded portion and the driving member, the widened portion bearing radially against a bore of one of the two posts.

11. The motor according to claim 8, wherein the casing comprises two posts monolithically cast with the rest of the casing, the two posts being traversed by the worm, the threaded portion of the worm extending between the two posts;

the worm having a widened cylindrical portion between the threaded portion and the driving member, the widened portion bearing radially against a bore of one of the two posts; and the bushing bearing in a bore of the other post.

12. The motor according to claim 2, further comprising a locking lever for locking the worm in the clutch disengagement position and in the clutch engagement position.

13. The motor according to claim 2, wherein the rotor drives an elevator cable drive pulley without downshifting.

14. The motor according to claim 2, further comprising an electromagnetic brake.

15. The motor according to claim 14, wherein rotation of the worm, once coupled to the toothed wheel, is enabled when the brake is in a braking configuration.

16. The motor according to claim 14, further comprising a safety system prohibiting the unlocking of the brake in the absence of coupling of the worm and the toothed wheel.

17. The motor according to claim 16, wherein the safety system comprises a blocking member of the brake, configured to prevent the unblocking of the brake in the absence of coupling of the worm and the toothed wheel.

18. The motor according to claim 17, wherein the worm comprises a groove, the blocking member positioning itself opposite this groove when the worm is coupled with the toothed wheel, the groove enabling release of the blocking member from the brake and enabling unlocking of the brake.

19. The motor according to claim 17, further comprising a locking lever for locking the worm in the clutch disengagement position and in the clutch engagement position, and a safety bolt configured to immobilize the locking lever in the locked position, the actuation of the safety bolt enabling passage of the locking lever into an unlocked position and permitting a movement of the worm, the safety bolt being configured to act on the blocking member in the unlocked position, so as to prevent unblocking of the brake, the safety bolt being kept in the unlocked position by the locking lever as long as the locking lever is unlocked.

20. The motor according to claim 19, wherein the safety bolt is enabled for manual actuation.

21. The motor according to claim 12, wherein the locking lever comprises a fork engaging on the worm when the locking lever is in a locking position and the worm is in one of the clutch engagement or clutch disengagement positions.

22. The motor according to claim 17, further comprising a locking lever for locking the worm in the clutch disengagement position and in the clutch engagement position and wherein the locking lever comprises a fork engaging the worm when the locking lever is in a locking position and the worm is in one of the clutch engagement or clutch disengagement positions, and the worm comprises a first groove in which the fork engages when the worm is disengaged and a second groove in which the fork engages when the worm is engaged, the first groove authorizing the release of the blocking member to permit unlocking of the brake.

23. The motor according to claim 14, further comprising an actuating arm which may pivot to act on the brake to unlock the brake.

24. The motor according to claim 23, wherein the arm acts on the brake via a control cable.

25. The motor according to claim 23, wherein the locking lever is rotatable in a first direction to go from the locking position to the unlocking position and supporting the actuating arm, which may pivot in a second direction opposite the first.

26. The motor according to claim 1, wherein passage of the worm between the clutch engagement position and the clutch disengagement position is performed via axial movement of the worm.

27. The motor according to claim 1, wherein the driving member comprises a crank and/or a handwheel.

28. The motor according to claim 1, wherein the motor drives an elevator car.

29. A method for driving a motor equipped with an auxiliary driving system including a casing, a toothed wheel rotating with a rotor inside the casing during normal operation of the motor, a worm and a driving member, the method comprising: enabling the worm to be brought into a clutch engagement position wherein the worm meshes with the toothed wheel, rotation of the worm drives the toothed wheel in a non-reversible manner and removable from the clutch engagement position to allow the normal operation of the motor: enabling, by the driving member, manual rotation of the worm by direct engagement, the driving member rotating around the same axis of rotation as the worm:

acting on the worm to couple the worm the toothed wheel:

manually driving the worm in rotation to drive the rotor.

30. The method according to claim 29, wherein the worm is driven in rotation against the braking action of the brake.

31. The method according to claim 29, wherein the worm is driven in rotation following unlocking of the brake.

32. The method according to claim 29, wherein the motor drives an elevator car.

* * * * *